US005779543A

United States Patent [19]

Sisilli

[11] Patent Number: 5,779,543

[45] Date of Patent: Jul. 14, 1998

[54] MULTI-LAYER BUSINESS FORM

[75] Inventor: Jeffrey M. Sisilli, North Hollywood, Calif.

[73] Assignee: The Reynolds and Reynolds Company, Dayton, Ohio

[21] Appl. No.: 536,637

[22] Filed: Sep. 29, 1995

[51] Int. Cl.[6] ..... B41L 1/20

[52] U.S. Cl. ..... 462/28; 462/8; 462/69

[58] Field of Search ..... 462/7.8, 17, 18, 462/19–25, 28, 53, 55, 56, 67, 69, 900

[56] References Cited

U.S. PATENT DOCUMENTS

| | | | |
|---|---|---|---|
| 603,861 | 5/1898 | Shaft et al. | 462/56 X |
| 2,089,247 | 8/1937 | Benson | 462/209 |
| 2,092,127 | 9/1937 | Lankton | 462/56 |
| 2,120,162 | 6/1938 | Stevens | 462/55 |
| 2,166,016 | 7/1939 | Morrison | 462/55 |
| 2,170,241 | 8/1939 | Hall | 462/55 |
| 2,386,872 | 10/1945 | Lewis | 462/55 X |
| 2,615,865 | 10/1952 | Sheenan . | |
| 3,243,204 | 3/1966 | Schwab et al. . | |
| 4,682,793 | 7/1987 | Walz | 462/2 |

*Primary Examiner*—Frances Han
*Attorney, Agent, or Firm*—Reid & Priest L.L.P.

[57] ABSTRACT

A set of legal form blanks intended for conveying information obtained during a single legal transaction to a plurality of legal entities. A horizontal first line of separation is provided across the entire width of the legal form blanks for separation of the legal form blanks after completion into documents having separate uses or purposes. A vertical second line of separation is provided perpendicular to the first line of separation such that left and right sets of legal form blanks are formed. Common information and different but related information can be provided on immediately adjacent legal form blanks of the left and right sets of legal form blanks.

17 Claims, 3 Drawing Sheets

52
54
56
58

50
15
62
60
22
40
24
28
29
TRADE-IN PAY-OFF ADJUSTMENT
PAYOFF ADJUSTMENT
AUTHORIZATION FOR PAYOFF
BILL OF SALE
BILL OF SALE
PAYOFF ADJUSTMENT
36
NOTICE OF RELEASE OF LIABILITY
ORIGINAL - TO DEPT. OF MOTOR VEHICLES
SELLERS COPY
BUYERS COPY
POWER OF ATTORNEY
POWER OF ATTORNEY
59
20
30
32
26
27

MULTI-LAYER BUSINESS FORM

BACKGROUND OF THE INVENTION

1. Field of the Invention

The present invention relates to an improved business form and the system of producing it. More specifically, the invention relates to an assembly or combination of certain documents in a partially prepared form, whereby completion of such documents may be accomplished in a single operation.

2. Related Art

Examples of prior art documents in the form of such manifold sets are shown in U.S. Pat. No. 3,243,204 to Schwab et al. and U.S. Pat. No. 2,614,865 to Sheenan. When a business transaction includes preparation of several documents forming parts of the same transaction, and therefore having certain common subject matter appearing in all of the documents, as well as individual subject matter appearing only in one or some of the documents, the manifold set of partially prepared business form blanks can simplify the preparation of such documents by eliminating the necessity of selecting proper forms involved in the transaction.

As shown in Schwab et al. '204, the business form blanks involved in a single transaction can be assembled together with each blank forming a part of the assembly and having its printed subject matter so arranged thereon, and the individual blanks of the assembly connected together in such spaced relation to each other, and having interposed therein a sheet of copy-producing medium, for example carbon paper, with both effective and ineffective portions in such spaced relation to the documents so that although typing is done on the top surface of the assembly, only the common subject matter required on each document appears thereon in proper places. While the above-described system of producing business documents greatly simplifies the preparation of such documents over earlier systems, the existing systems fail to recognize the problems associated with preparing business documents in a single transaction when the documents are ultimately intended for different entities.

An example of such a transaction occurs during the trade-in of a motor vehicle to an auto dealership. During the trade-in of a motor vehicle, separate documents are required to be sent to the Department of Motor Vehicles and to the existing lienholder for the vehicle; in addition, separate documents are retained by the customer and the dealer. During the preparation of the legal documents for a transaction such as a motor vehicle trade-in, it is often desired by the parties to the transaction that information being provided to a first entity, such as the Department of Motor Vehicles, be readily visible during the completion and witnessing of information provided on a document to be sent to a second entity. The existing systems of producing legal and other business documents do not allow for such an easy comparison of information provided on the different blank forms that are ultimately intended for different entities, since only the portions of subjacent form blanks that extend below the lower edge of the top form blank provided in the manifold set are visible during completion of the document.

SUMMARY OF THE INVENTION

The present invention relates to an improved assembly or set of partially prepared documents or business form blanks intended for conveying information provided in connection with a single business transaction to a plurality of entities. A plurality of form blanks are provided having upper and lower edges with the upper edges being aligned. The form blanks are secured together along their aligned upper edges to form a unitary structure for simultaneous typing or computer printing or handwriting, with the printing being done only on a top surface of the structure. The top surface of the structure is formed by one side of a top form blank in the assembly of form blanks. The form blanks have aligned horizontal first lines of separation provided across their entire width, parallel to their aligned upper edges for separation of the form blanks into documents having separate end uses.

The form blanks also have aligned vertical second lines of separation provided perpendicular to the horizontal lines of separation. The vertical lines of separation divide the width of the form blanks and extend the entire length of the form blanks such that a left first set of blanks is formed on the left-hand side of the vertical line of separation and a right second set of blanks is formed on the right-hand side of the vertical line of separation. As a result of having adjacent left and right sets of form blanks, two sets of documents intended for separate entities can be prepared before the separation of the sets along the vertical line of separation, with the information on both sets of documents being readily visible during their preparation.

The left and right sets of form blanks each include a top form blank and a plurality of subjacent form blanks of increasing length, i.e., with each succeeding blank having a length greater than that of its preceding blank. The blanks have first areas of special printed matter (such as the printed matter relating to identification of a motor vehicle being traded in) and the first areas of special printed matter can be required to appear on the top blank and all subjacent blanks of both of the left and right sets of blanks. The blanks can also be provided with second areas of special printed matter with the second areas of special printed matter being required to appear on the top blank and a first subjacent blank of both of the left and right sets of blanks. Additionally, the blanks can be provided with third areas of special printed matter, with the third areas of printed matter being required to appear on the top blank and the first subjacent blank of both of the left and right sets of blanks, and on a second subjacent blank of the left set of blanks.

A first sheet of copy-producing medium, for example carbon paper, having an effective portion, with the effective portion providing a means for transferring information, is provided between the top blank and the first subjacent blank, with the effective portion being in registry with the first and second areas of special printed matter. A second sheet of carbon paper having effective and ineffective portions is provided between the first and second subjacent blanks, with the effective portion being in registry with the first and third areas of printed matter and with the ineffective portion being in registry with printed matter that has to appear on the first subjacent blank but not on the second subjacent blank. Information provided on adjacent form blanks of the left and right sets of blanks can include common information as well as different but related information. Like the form blanks, the sheets of copy-producing medium are provided with aligned horizontal and vertical lines of separation, to enable separation of the sheets from the assembly and separation of the two sets of documents.

As a result of the improved design of the present invention, information provided on one of the form blanks that is different from information provided on a separate form blank making up part of the assembly, can be filled in while referring to related information provided on an adjacent blank. The provision of left and right sets of form blanks on opposite sides of the vertical line of separation allows such a comparison of related information during preparation of the document without having to move or separate any of the form blanks, and while retaining the portions of the subjacent form blanks extending below the lower edge of the top form blank for information having an educational purpose.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figures 1, 2, 3, 4, 5, 6:
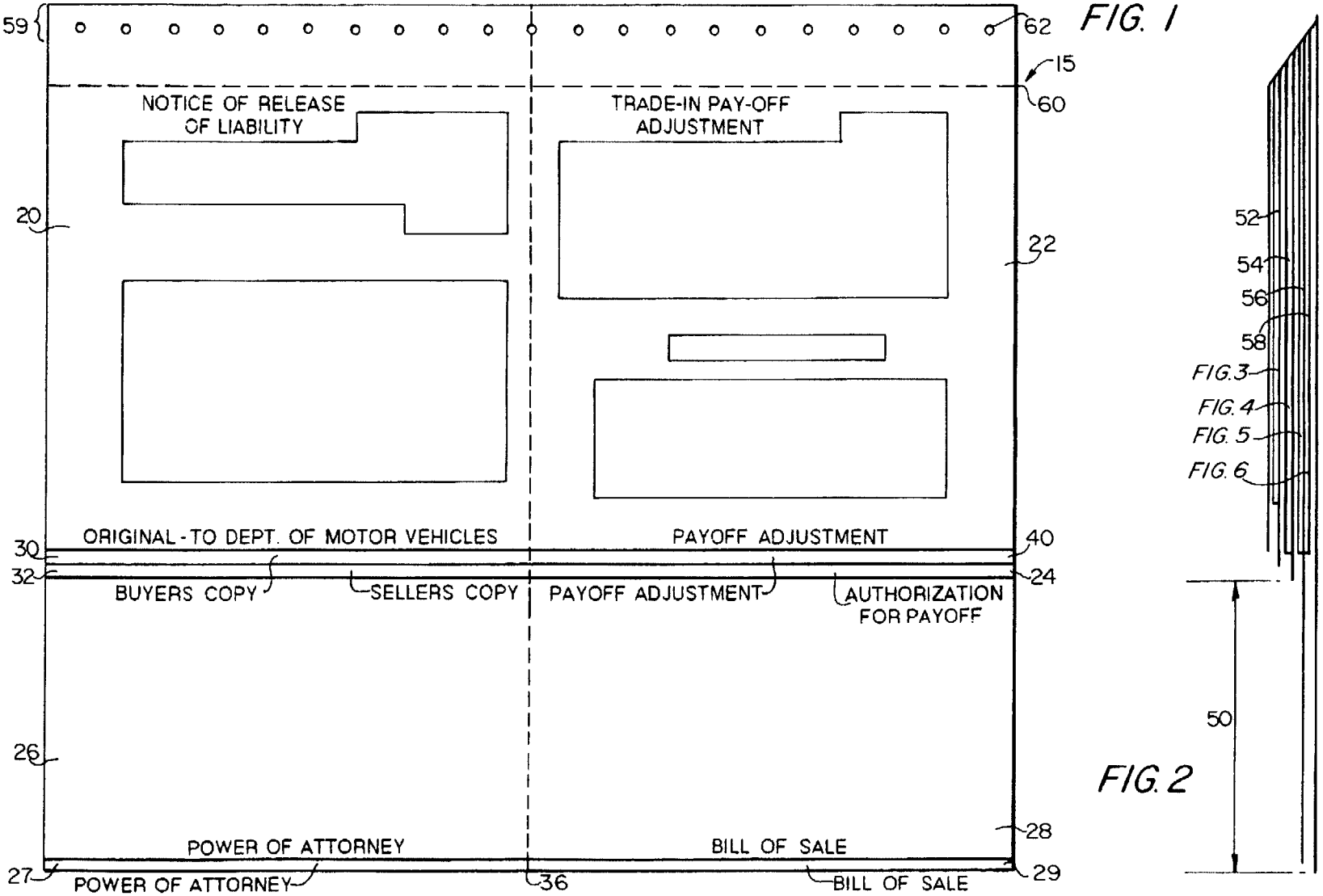
FIG. 1 illustrates a front view of the assembly or set of form blanks embodying the present invention.
FIG. 2 illustrates a side elevation view of the assembly or set of FIG. 1
FIG. 3 illustrates a front view of the first sheet of copy-producing medium, such as a sheet of carbon paper, showing the arrangement of effective portions thereon.
FIG. 4 illustrates a front view of the second copy-producing medium, such as a sheet of carbon paper, showing the arrangement of effective and ineffective portions thereon.
FIG. 5 illustrates a front view of the third copy-producing medium, such as a sheet of carbon paper, showing the arrangement of the effective and ineffective portions thereon.
FIG. 6 illustrates a front view of the fourth copy-producing medium, such as a sheet of carbon paper, showing the arrangement of the effective and ineffective portions thereon.
Figure 3:
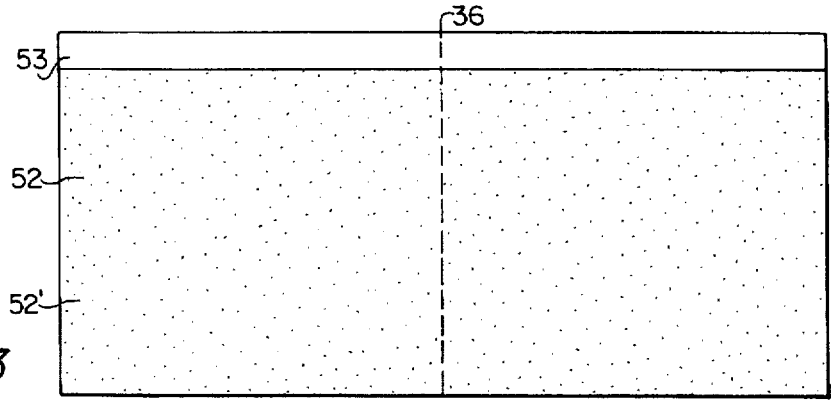
Figure 4:
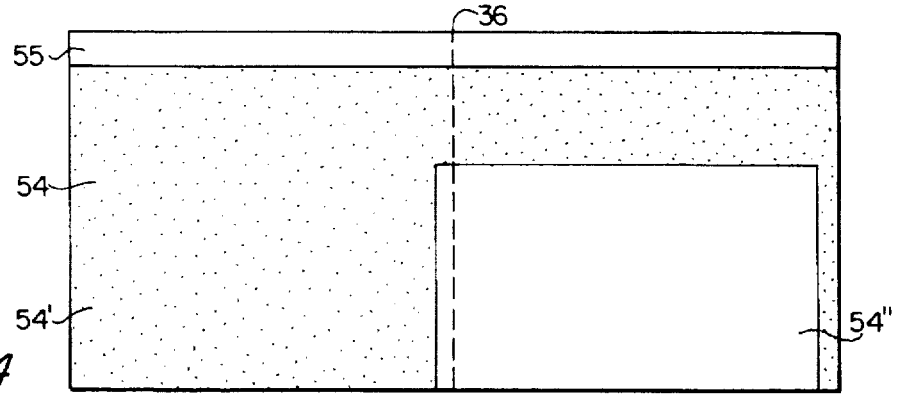
Figure 5:
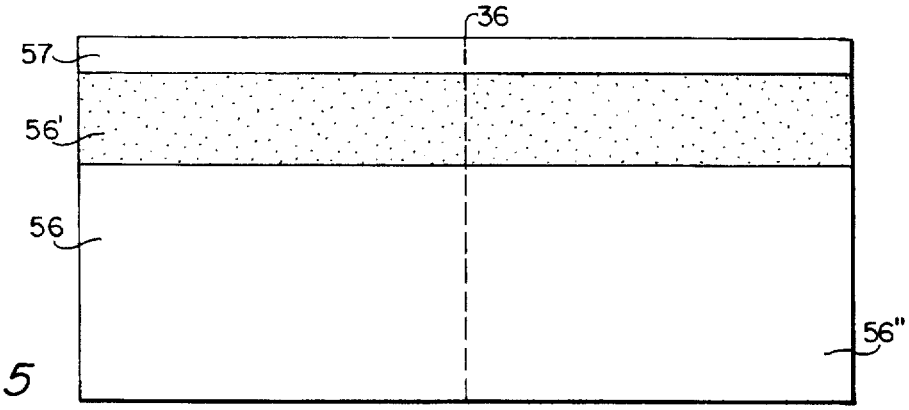
Figure 6:
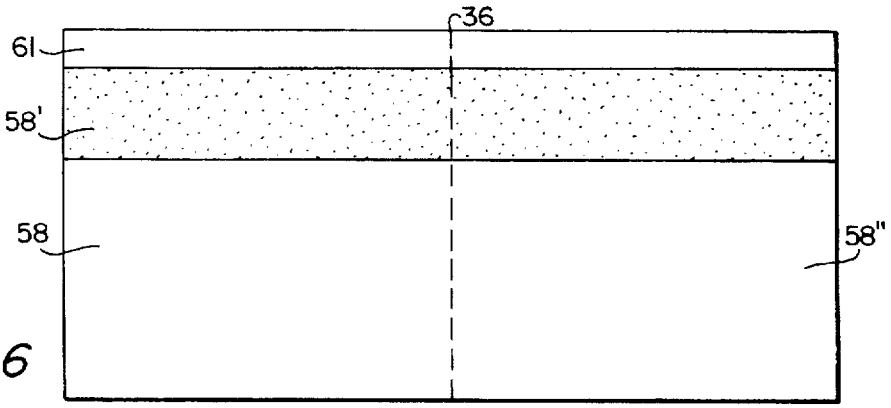

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

A preferred embodiment of the multi-layer form according to the present invention is shown in FIG. 1. The present invention is illustrated and described herein with reference to an assembly 15 including form blanks for a Notice of Release of Liability, a Trade-In Payoff Adjustment, an Authorization for Payoff, a Power of Attorney, and a Bill of Sale. All of these forms are filled out and signed as part of a motor vehicle trade-in transaction. It will be understood, however, that the present invention is applicable to form blanks suitable for a variety of business (including legal) transactions. A distinct advantage of the assembly of form blanks according to the present invention, over the form blanks known in the art is provided by the placement of two (2) separable sets of blanks intended ultimately for separate entities and having areas for common information as well as different but related information, adjacent each other on the assembly.

Referring to FIG. 1, there is shown therein, by way of example, an assembly 15 of form blanks comprising a Notice of Release of Liability form 20, a Trade-In Payoff Adjustment form 22, an Authorization for Payoff form 24, a Power of Attorney form 26, and a Bill of Sale form 28. An additional Buyer's Copy form 30 and Seller's Copy form 32 of the Notice of Release of Liability form are provided subjacent form 20 and on the left-hand side of aligned central vertical lines of separation 36, that consists of aligned lines of perforations dividing the entire width of the assembly 15.

An additional Payoff Adjustment form 40 is provided subjacent the top Trade-In Payoff Adjustment form 22 and on the right-hand side of the vertical line of separation 36. A copy 27 of the Power of Attorney form 26 and a copy 29 of the Bill of Sale form 28 are provided subjacent the Seller's Copy 32 of the Notice of Release of Liability form 20 and the Authorization for Payoff form 24 on the left and right sides, respectively, of the vertical lines of separation 36. The form blanks provided on one or both sides of the vertical lines of separation 36 are preferably of equal width, although in some applications it may be possible for the vertical lines of separation 36 to be positioned to divide the form blanks into sets of unequal widths.

In general, the form blanks are of increasingly greater length, i.e., each succeeding blank has a length greater than that of its preceding blank. Thus, the lower edge of each form blank is visible. The title of each succeeding blank, or other information, can be provided on this visible lower edge.

In addition, the form blanks of the Power of Attorney forms 26, 27 on the left side of the vertical lines of separation 36, and of the Bill of Sale forms 28, 29 on the right side of the vertical lines of separation 36 are substantially longer than the Notice of Release of Liability forms 20, 30, and 32, and the Trade-In Payoff Adjustment forms 22 and 40 and Authorization for Payoff form 24, as shown in FIGS. 1 and 2. Specifically, a portion of the Power of Attorney form 26 and the Bill of Sale form 28 extends below the lower edge of the Seller's Copy 32 of the Notice of Release of Liability form 20 and the Authorization for Payoff form 24. Thus, the Notice of Release of Liability forms 20, 30, and 32, and the Trade-In Payoff Adjustment forms 22 and 40 and Authorization for Payoff form 24 define a forward first set of documents, while the Power of Attorney forms 26, 27 on the left side of the vertical lines of separation 36, and of the Bill of Sale forms 28, 29 on the right side of the vertical lines of separation 36 define a rearward second set of documents. The lower extending portions of the rearward second set of documents can be provided with preprinted information for informational or educational purposes.

The vertical lines of separation 36 allow for two (2) forms having different purposes, such as the Notice of Release of Liability form 20 and the Trade-In Payoff Adjustment form 22, to be placed immediately adjacent each other for easy comparison during completion of the forms.

Sheets 52, 54, 56 and 58 of copy-producing medium, such as carbonized paper (hereinafter referred to as "carbon paper") are interposed between the form blanks. The form blanks and the sheets of carbon paper are assembled to have their upper and side edges in registry, and can be held together by a narrow strip of adhesive 59 running along the top edge of assembly 15. Each sheet is no longer than the form blank immediately above it, so as not to obscure the next subjacent form blank.

The vertical and horizontal lines of separation 36 and 60 also extend through sheets 52, 54, 56, and 58. Thus, after completion, the form blanks can be separated from the assembly 15 along aligned horizontal lines of separation 60 and then separated from each other along the vertical lines of separation 36.

Aligned horizontal rows of holes 62 can also be provided in the form blanks and sheets of copy-producing medium parallel to the top edge of the assembly 15, downwardly of the strip of adhesive 59, in order to provide a means for driving the assembly 15 during a printing operation.

As will be appreciated by those of skill in the art, the sheets of copy-producing medium can be replaced by other copy-producing equivalents, such as so-called "carbonless" copy systems, wherein the back side of an upper sheet and the front side of its subjacent sheet are treated to transfer an image onto the front side of the subjacent sheet when pressure is applied to the front side of the upper sheet.

The printed contents and the blank spaces of the form blanks, and the effective or carbonized portions of the carbon sheets are so composed and are arranged thereon in such spaced relations to each other that when the form blanks are connected together, and the blank spaces of the form blanks are filled in with subject matter common to all of the form blanks 20, 30, 32, 26 and 27 on the left side of the vertical lines of separation 36, and form blanks 22, 40, 24, 28 and 29 on the right side of the vertical line of separation 36; the spaces are in registration with each other and with the effective or carbonized portions of the carbon paper sheets 52, 54, 56, and 58.

Carbon sheet 52 includes a narrow strip 53 across its top edge for adhering it to the assembly 15, and the remainder of carbon sheet 52 consists of an effective or carbonized portion 52'. Carbon sheet 52 is sandwiched between top form blanks 20 and 22 and subjacent form blanks 30 and 40. When special matter is printed, typed, or written in the spaces provided on top form blanks 20 and 22 before the separation of the form blanks along lines of separation 36 and 60, this matter will also appear in its entirety on form blanks 30 and 40 because the effective portion 52' of carbon sheet 52 covers the entire area of printed matter on forms 20, 22, 30 and 40.

Carbon sheet 54 lies between form blanks 30 and 40 and form blanks 32 and 24. Special matter that is intended to appear on top form blank 22 and subjacent form blank 40 but not on subjacent form blanks 24, 28 or 29, is in registration with the non-effective portions 54" of carbon sheet 54.

Subject matter that is to appear only on form blanks 26, 27, 28 and 29, can be typed or printed onto the areas of these forms underlying the non-effective portions 56" and 58" of carbon sheets 56 and 58, respectively. This information is filled in after the separation of the form blanks along horizontal line of separation 60.

As will be appreciated by those of skill in the art, where a carbonless copy system is used in place of sheets of copy-producing medium such as carbon paper, the back and front facing sides of the form blanks are themselves provided with effective and non-effective portions. The effective portions are coated in conventional fashion to provide reproduction, while the non-effective portions are uncoated.

Every form blank in assembly 15 that is subjacent another form blank is provided with a portion extending below the lower edge of the form blank immediately above, such that an information band can be provided on the extending portion for identification of the purpose of the subjacent form blank or for other informational purposes.

The assembly 15 in its connected form thus presents the appearance of separate sets of form blanks connected together and having sheets of carbon paper in between adjacent form blanks. Left and right sets of form blanks are provided on respective sides of the vertical line of separation 36. Sets of such nature can be packaged in any desired number and supplied to institutions such as car dealerships.

For use, a set of such form blanks is inserted into a computer printer or a typewriter, enabling blank spaces in registration with each other to be completed simultaneously. When a computer printer is used, the information required for completion of the form is entered through a computer associated with the printer. Entry of the information is then governed by a computer program tailored to the form blanks. The preparation of such a computer program is well within the ordinary skill of one in the computer programming art, and forms no part of the present invention.

Figure 7:
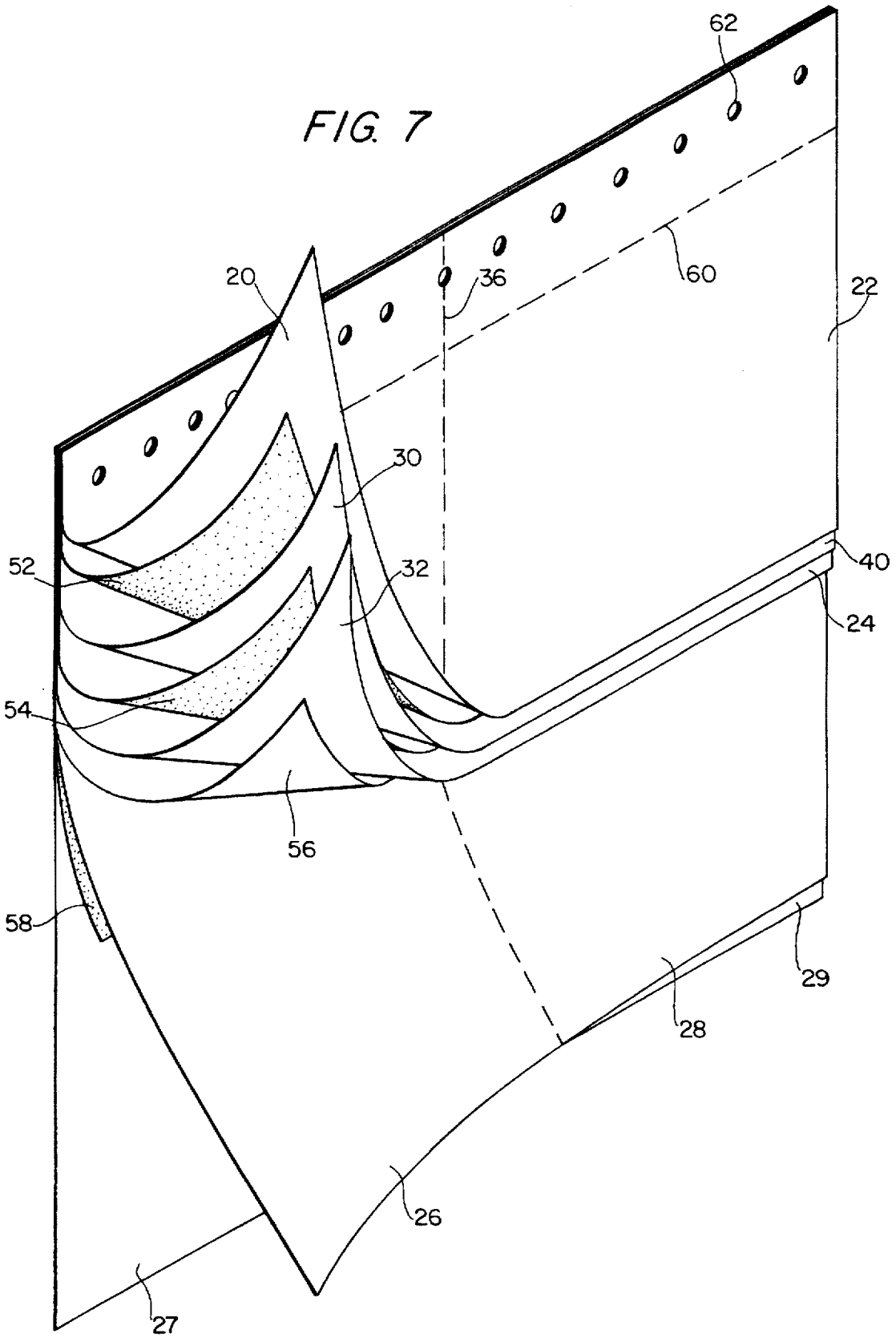
FIG. 7 illustrates a perspective view of an assembly or set of form blanks according to the present invention, showing one corner of each of the blanks curled up in order to reveal the subjacent copy-producing medium and blank.

Special information that is to be inserted only on one form blank, for example on form blank 24 located third from the top, as shown in FIGS. 1 and 7, is typed in after the separation of the form blanks along vertical and horizontal lines of separation 36 and 60. The ineffective portion 54" of carbon sheet 54 prevents the transfer of any information from preceding form blanks 22 and 40 onto this portion of form blank 24. Similarly, special information that is to be inserted only on form blanks 26, 28, 27, and 29, can be typed or otherwise entered onto these form blanks after the separation of the forms. Such special information would be inserted in the areas that are overlayed by ineffective portions 56" and 58" of carbon sheets 56 and 58.

Modifications and variations of the above-described embodiments of the present invention are possible, as appreciated by those skilled in the art in light of the above teachings. For example, the subject matter provided on the form blanks can vary and the location of ineffective and effective portions on the carbon sheets can vary.

It is therefore to be understood that, within the scope of the appended claims and their equivalents, the invention may be practiced otherwise than as specifically described.

What is claimed is:

1. A multi-layer form comprising:

a plurality of layered form blanks having upper and lower edges, said upper edges of said form blanks being substantially aligned, said plurality of form blanks including a top form blank and a plurality of subjacent forms blanks layered below said top form blank, with each successively lower subjacent form blank having length greater than said form blank immediately above it to define a lower portion extending below said lower edge of said form blank immediately above it, for the display of information;

a plurality of sheets of copy-producing medium interleaved with said plurality of form blanks, said sheets of copy-producing medium having upper and lower edges, said upper edges of said sheets of copy-producing medium being substantially aligned with said upper edges of said form blanks;

said form blanks and said sheets of copy-producing medium being secured at said upper edges to form a unitary structure for entry of information to effect simultaneous completion of parts of said form blanks, said unitary structure having a top surface defined by one side of said top form blank, each of said form blanks being provided with a horizontal line of separation extending across the entire width thereof, all said horizontal lines of separation being in registration with each other, and each of said form blanks and said sheets of copy-producing medium being provided with a vertical line of separation perpendicular to said horizontal lines of separation, all of said vertical lines of separation being in registration with each other and extending along the entire lengths of said form blanks and said sheets of copy-producing medium including said upper edges of said form blanks and said sheets of copy-producing medium said vertical lines of separation permitting separation of said form blanks and said sheets of copy-producing medium into left and right sets of documents each having an upper edge, and in which all documents in a set are secured at said upper edge of said set, and said horizontal lines of separation permitting separation of said form blanks from each other.

2. The multi-layer form of claim 1, wherein each said sheet of copy-producing medium is no longer than the form blank immediately above it.

3. The multi-layer form of claim 1, wherein at least some of said sheets of copy-producing medium have both an effective area to effect transfer of information to the form blank immediately below and an ineffective area to prevent transfer of information to the form blank immediately below.

4. The multi-layer form of claim 1, wherein said structure further has aligned horizontal rows of holes provided in said form blanks and said sheets of copy-producing medium extending across the entire width thereof upwardly of said aligned horizontal lines of separation.

5. The multi-layer form of claim 1, wherein said blank forms are of increasingly greater length.

6. The multi-layer form of claim 1, wherein said structure is divided into a forward first set of documents and a rearward second set of documents, said rearward second set of documents being of substantially longer length than said forward first set of documents.

7. The multi-layer form of claim 5, wherein said structure is divided into a forward first set of documents and a rearward second set of documents, said rearward second set of documents being of substantially longer length than said forward first set of documents.

8. The multilayer form of claim 1, wherein said sheets of copy-producing medium are separable from said form blanks along said upper edges of said sheets of copy-producing medium.

9. A multi-layer form comprising:

a plurality of layered form blanks having upper and lower edges, said upper edges of said form blanks being substantially aligned, said plurality of form blanks including a top form blank and a plurality of subjacent forms blanks layered below said top form blank, with each successively lower subjacent form blank having length greater than said form blank immediately above it to define a lower portion extending below said lower edge of said form blank immediately above it, for the display of information;

copy-producing means for transferring information from said top form blank to said subjacent form blanks;

said form blanks being secured along said upper edges to form with said copy-producing means a unitary structure for entry of information to effect simultaneous completion of parts of said form blanks, said unitary structure having a top surface defined by one side of said top form blank, each of said form blanks being provided with a horizontal line of separation extending across the entire width thereof, all of said horizontal lines of separation being in registration with each other, and each of said form blanks being provided with a vertical line of separation perpendicular to said horizontal lines of separation, all of said vertical lines of separation being in registration with each other and extending along the entire length of said form blanks including said upper edges, said vertical lines of separation permitting separation of said form blanks into left and right sets of documents each having an upper edge, and in which all form blanks in a set are secured at said upper edge of said set, and said horizontal lines of separation permitting separation of said form blanks from each other.

10. The multi-layer form of claim 9, wherein said copy-producing means have both an effective area to effect transfer of information for selective transfer of information from said top form blank to said subjacent form blanks.

11. The multi-layer form of claim 9, wherein said structure further has aligned horizontal rows of holes provided in said form blanks extending across the entire width thereof upwardly of said aligned horizontal lines of separation.

12. The multilayer form of claim 9, wherein said blank forms are of increasingly greater length.

13. The multi-layer form of claim 12, wherein said structure is divided into a forward first set of documents and a rearward second set of documents, said rearward second set of documents being of substantially longer length than said forward first set of documents.

14. The multi-layer form of claim 9, wherein said structure is divided into a forward first set of documents and a rearward second set of documents, said rearward second set of documents being of substantially longer length than said forward first set of documents.

15. A multi-layer form for conveying information to a lienholder for a motor vehicle and to the Department of Motor Vehicles comprising:

a plurality of form blanks having upper and lower edges with said upper edges being substantially aligned, said form blanks being secured together along their upper edges to form a unitary structure having a top surface for simultaneous computer printing of all of said form blanks;

said top surface of said structure forming one side of a top blank;

a first line of separation provided in each of said form blanks extending across the entire width thereof parallel to said upper edges of said form blanks, all of said first lines for separation being in registration with each other, for separation of said form blanks into documents having separate legal meaning;

a second line of separation provided in each of said form blanks perpendicular to said first lines of separation, all of said second lines of separation being in registration with each other and extending along the entire lengths of said form blanks including said upper edges thereof, such that said second lines of separation divide the width of said form blanks and extends the entire length of said form blanks, including said upper edges, such that a first set of form blanks having an upper edge is formed on the left-hand side of said second lines of separation and a second set of form blanks having an upper edge is formed on the right-hand side of said second lines of separation, all form blanks in each of said first and second sets being secured at said upper edges of said first and second sets;

said left and right sets of form blanks each including a top blank and a plurality of subjacent form blanks having length greater than that of said top blank;

said form blanks having first areas of special printed matter with said first areas of special printed matter required to appear on said top blank and all subjacent form blanks of both said left and right sets of form blanks;

said form blanks having second areas of special printed matter with said second areas of special printed matter required to appear on said top blank and a first subjacent blank of both of said left and right sets of form blanks;

said form blanks having third areas of special printed matter with said third areas of special printed matter required to appear on said top blank and said first subjacent blank of both of said left and right sets of form blanks, and on a second subjacent blank of said left set of form blanks;

a first sheet of carbon paper having an effective portion provided between said top blank and said first subjacent blank, with said effective portion being in registry with said first and said second areas of printed matter, said first sheet of carbon paper having a second line of separation in registration with said second lines of separation provided in said form blanks; and a second sheet of carbon paper having effective and ineffective portions and provided between said first and second subjacent form blanks, with said effective portion being in registry with said first and third areas of printed matter and with said ineffective portion being in registry with printed matter that has to appear on said first subjacent blank but not on said second subjacent blank, said second sheet of carbon paper having a second line of separation in registration with said second lines of separation provided in said form blanks.

16. The multi-layer form of claim 15, wherein said first and second sheets of carbon paper are separable from said form blanks.

17. A multi-layer form for conveying information to a lienholder for a motor vehicle and to the Department of Motor Vehicles comprising:

a plurality of form blanks having upper and lower edges with said upper edges being substantially aligned, said form blanks being secured together along their upper edges to form a unitary structure having a top surface for simultaneous computer printing of all of said form blanks;

said top surface of said structure forming one side of a top blank;

a first line of separation provided in each of said form blanks extending across the entire width thereof parallel to said upper edges of said form blanks, all of said first lines for separation being in registration with each other, for separation of said form blanks into documents having separate legal meaning;

a second line of separation provided in each of said form blanks perpendicular to said first lines of separation, all of said second lines of separation being in registration with each other and extending along the entire lengths of said form blanks including said upper edges thereof, such that said second lines of separation divide the with of said form blanks and extends the entire length of said form blanks, including said upper edges, such that a first set of form blanks having an upper edge is formed on the left-hand side of said second lines of separation and a second set of form blanks having an upper edge is formed on the right-hand side of said second lines of separation, all form blanks in each of said first and second sets being secured at said upper edges of said first and second sets;

said left and right sets of form blanks each including a top blank and a plurality of subjacent form blanks having length greater than that of said top blank;

said form blanks having first areas of special printed matter with said first areas of special printed matter required to appear on said top blank and all subjacent form blanks of both said left and right sets of form blanks;

said form blanks having second areas of special printed matter with said second areas of special printed matter required to appear on said top blank and a first subjacent blank of both of said left and right sets of form blanks;

said form blanks having third areas of special printed matter with said third areas of special printed matter required to appear on said top blank and said first subjacent blank of both of said left and right sets of form blanks, and on a second subjacent blank of said left set of form blanks;

first copy-producing means for transferring information from said top blank to said first subjacent blank, said first copy-producing means having an effective portion in registry with said first and said second areas of printed matter; and second copy-producing means for transferring information from said first subjacent blank to said second subjacent blank, said second copy-producing means having an effective portion in registry with said first and third areas of printed matter and an ineffective portion in registry with printed matter that has to appear on said first subjacent blank but not on said second subjacent blank.

* * * * *

UNITED STATES PATENT AND TRADEMARK OFFICE

CERTIFICATE OF CORRECTION

PATENT NO. : 5,779,543
DATED : July 14, 1998
INVENTOR(S) : Jeffrey M. SISILLI

It is certified that error appears in the above-identified patent and that said Letters Patent is hereby corrected as shown below:

Column 6, line 64, after "all" insert --of--;

Column 7, line 7, after "medium" insert a --,-- (comma);

Column 10, line 6, change "with" to --width--.

Signed and Sealed this

Fifth Day of January, 1999

*Attest:*

*Attesting Officer*

*Acting Commissioner of Patents and Trademarks*